United States Patent [19]

Beer et al.

[11] 4,061,256

[45] Dec. 6, 1977

[54] TENNIS BALL HOLDER TO BE WORN ON THE ARM

[76] Inventors: Irwin B. Beer, 7717 SW. 102nd Place, Miami, Fla. 33173; Sanford Siegal, 7720 SW. 102nd Place, Miami, Fla. 33143

[21] Appl. No.: 602,801

[22] Filed: Aug. 7, 1975

[51] Int. Cl.[2] ..... A45C 11/00

[52] U.S. Cl. ..... 224/5 D; 2/170; 224/28 B

[58] Field of Search ..... 224/5 R, 5 D, 28 R, 224/28 A, 28 B, 28 C, 28 D, 28 E, 28 P, 28 H, 28 G, 28 W, 45 L, 26 R, 5 C; 273/29 R, 73 R, 32 R, 32 D, 74; 2/170, 250; 206/315 B; 24/3 A

[56] References Cited

U.S. PATENT DOCUMENTS

| | | | |
|---|---|---|---|
| 847,467 | 3/1907 | Goodlett | 224/28 B |
| 2,127,926 | 8/1938 | Mason | 2/170 |
| 2,165,625 | 7/1939 | Fessel | 224/28 C X |
| 2,304,235 | 12/1942 | Boots | 224/5 D X |
| 2,548,330 | 4/1951 | Wiseman | 224/5 D |
| 2,558,382 | 6/1951 | Previdi | 2/250 X |
| 2,643,389 | 6/1953 | Wegner | 2/170 |
| 2,661,129 | 12/1953 | Seaton | 224/5 D |
| 2,926,912 | 3/1960 | Gould | 224/5 D X |
| 3,744,059 | 7/1973 | Hayes | 2/250 |
| 3,768,709 | 10/1973 | Kinard | 224/5 D |
| 3,873,009 | 3/1975 | Goudreau | 224/5 D |

FOREIGN PATENT DOCUMENTS

| | | | |
|---|---|---|---|
| 610,835 | 2/1926 | France | 224/28 B |
| 349,112 | 11/1960 | Switzerland | 224/5 R |
| 6,866 of | 1915 | United Kingdom | 224/28 B |
| 7,323 of | 1908 | United Kingdom | 224/5 D |

*Primary Examiner*—L. J. Paperner
*Assistant Examiner*—Winston H. Douglas
*Attorney, Agent, or Firm*—Millen & White

[57] ABSTRACT

A holder worn on the lower arm for carrying a tennis ball during a game utilizing a cotton and elastic armband to which is sewed a pouch comprising a circular elastic band through which the ball is inserted and a short loop of elastic material having its ends attached to the band for retaining the ball. A thin plastic tube may be inserted in the front rim of the circular elastic band for improved shape and increased strength and gripping power of the mouth of the pouch.

4 Claims, 3 Drawing Figures

FIG. 1
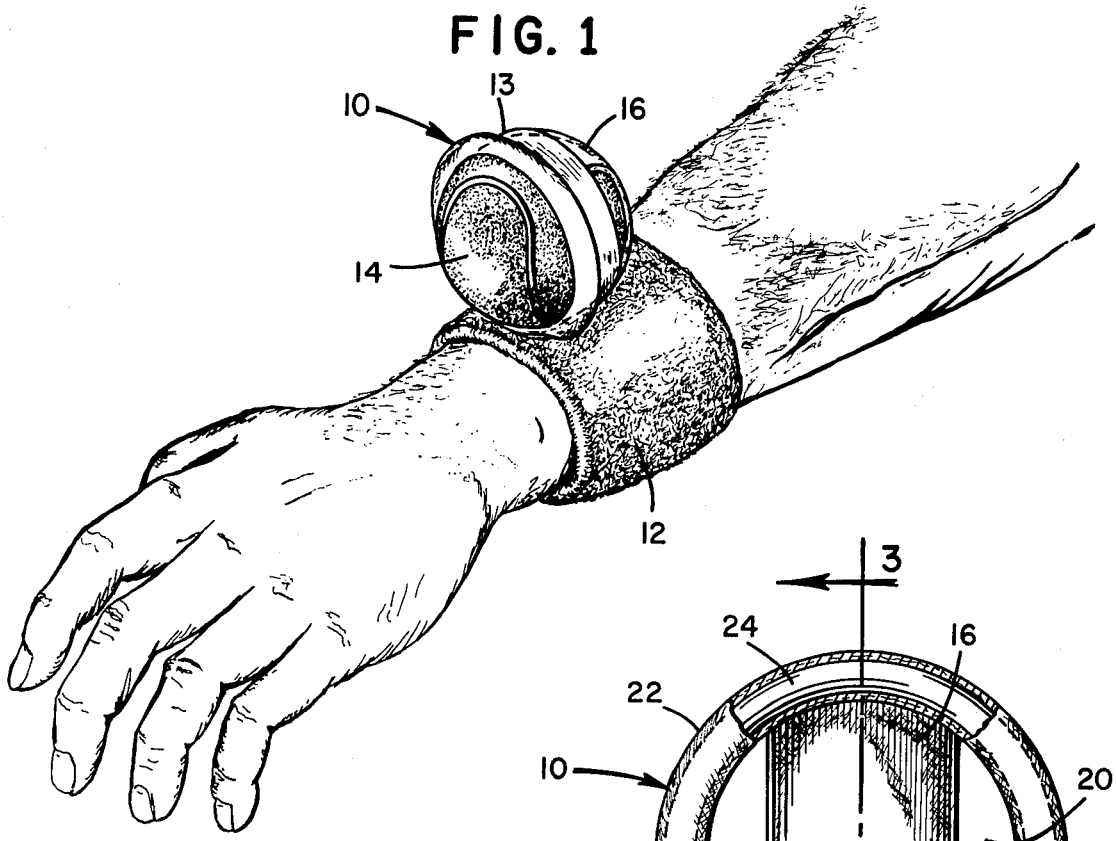
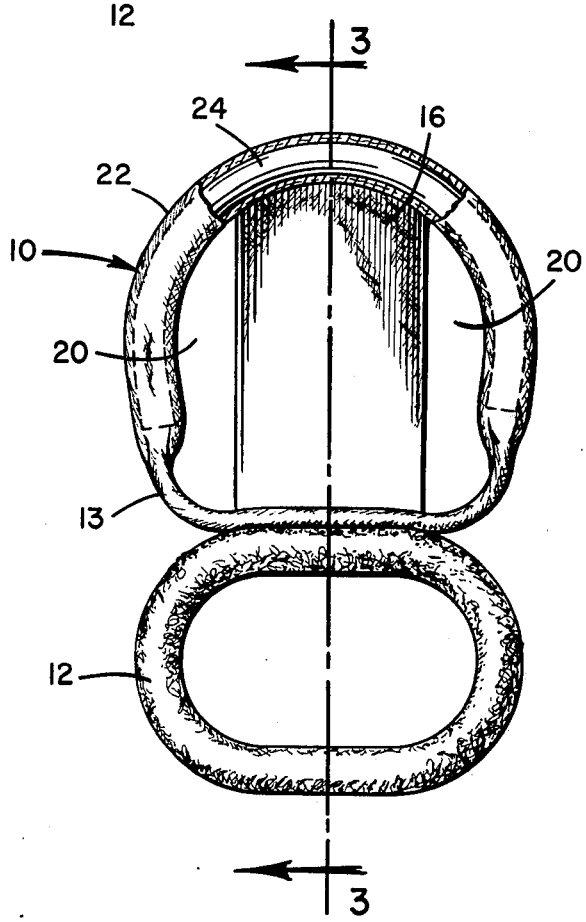
FIG. 2
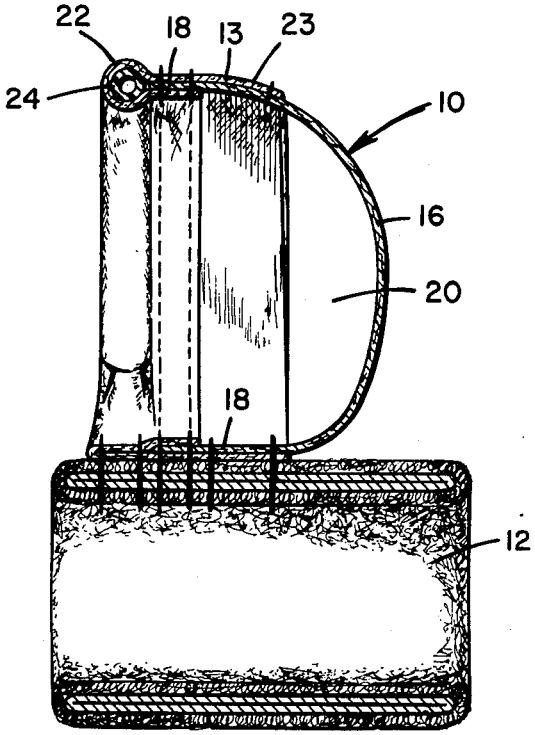
FIG. 3

TENNIS BALL HOLDER TO BE WORN ON THE ARM

FIELD OF THE INVENTION

This invention relates to a holder for a round, light weight object and more particularly to such a holder for a tennis ball to be worn on the lower arm.

BACKGROUND OF THE INVENTION

In the game of tennis, three balls are usually brought onto the court to be used when necessary. For most players and especially for women and children, it is difficult to hold three balls in one hand at the beginning of the serve. One ball is, therefore, often placed in a pocket of the player's garment with some difficulty or laid on the ground, where it may be stumbled over.

In case of a "let" serve, the third ball must be retrieved or one of the balls already served returned in order for the game to proceed.

In an effort to overcome similar inconvenience, in the game of golf, the prior art shows a device to be worn on the belt including two arcuate members pivoted together for gripping the ball. A flat spring extension on one member interacts with a thumb-operated extension on the other for tension between the members and for release of the ball.

It is difficult to insert a tennis ball quickly into such a device and there are hard projections on the device which may inadvertently catch and injure the arm of the player. The device must be threaded on a belt not usually worn by women and it is relatively complicated and expensive to manufacture.

It is, therefore, the principal object of this invention to improve holders for a tennis ball which may be worn during play.

It is also an object of this invention to provide a tennis ball holder to be worn comfortably on the lower arm and having a pouch for easy insertion and removal of the ball.

It is a further object of this invention to supply a tennis ball holder which is inexpensive to produce.

SHORT STATEMENT OF THE INVENTION

The objects of this invention have been accomplished by a tennis ball holder utilizing an absorbent and elastic band for encircling the lower arm to which is permanently attached a pouch including a substantially circular elastic band through which the ball is inserted and a short loop of elastic material having its ends attached to the elastic band for retaining the ball. A thin plastic tube may be contained in the front rim of the circular elastic band for improved shape and for increased strength, and gripping power of the mouth of the pouch.

The above-listed objects and accomplishments of the invention will become apparent from the following description of the invention and by referring to the drawing in which:

FIG. 1 is a perspective view of the tennis ball holder of the invention holding a tennis ball and worn on the arm of a player.

FIG. 2 is a front elevational view of the tennis ball holder of FIG. 1.

FIG. 3 is a cross-sectional view of the tennis ball holder taken along line 3—3 of FIG. 2.

DESCRIPTION OF THE PREFERRED EMBODIMENT

The tennis ball holder of the invention comprises a pouch section, numbered generally as 10, attached to an arm band 12 for encircling the lower arm, preferably just above the wrist.

The pouch 10 includes a substantially circular elastic band 13 through which the tennis ball 14 is to be inserted and a short loop 16 of elastic material having its ends 18 attached to the circular elastic band 13. The loop 16 is centered with respect to the elastic band 13 leaving open areas 20 on each side of loop 16.

The elastic band 13 and the loop 16 are of adequate width to support the tennis ball in the pouch. The open areas 20, however, provide space for the fingers of the wearer to press against the sides of the tennis ball 14 in removing the ball from the pouch 10.

The arm band 12 preferably is of sufficient length that the tennis ball 14 does not touch the arm of the wearer when the ball is in the pouch 10. The ball is thus prevented from direct contact with perspiration on the arm of the wearer in active play.

Additionally, the arm band 12 is fabricated of knitted cotton, such as terry cloth, or similar absorbent material, interwoven with elastic strands. The fabric of the arm band 12 is preferably soft for comfortable wear on the arm and of sufficient absorbency and thickness that the perspiration of the wearer does not customarily soak through the arm band and the material of the pouch 10 to the tennis ball 14 in the pouch.

An elastic cotton absorbent material fulfills the requirement of the arm band 12 satisfactorily and may be provided in a variety of sizes for arms ranging from those of small children to those of powerful men.

The tennis ball holder of the invention may be worn conveniently on the outside of the lower arm, or upper arm, if desired with the open end of the pouch facing the hand opposite the hand holding the tennis racket, as shown in FIG. 1. However, some players may prefer to have the open end of the pouch facing away from the hand, or to have the pouch on the inside of the arm. The tennis ball holder of the invention is equally convenient as to any such positioning desired by the wearer.

It is apparent that the arm band 12 will serve not only to attach the tennis ball-holding pouch 10, but also to prevent perspiration from running down the arm onto the hand.

The elastic band 13 and the loop 16 forming the pouch 10 may be of elastic material, such as that in which fabric-covered strands of elastic are woven longitudinally in a web with cross threads of cotton or similar material. For convenience and economy, the width of the material used to form the elastic band 13 may be the same as the width of the material forming the loop 16.

However, the top portion of the web of material forming the elastic band 13 is preferably folded inwardly to form a reinforcing and strengthening rim 22 at the mouth of the pouch 10.

The ends of the loop 16 may, for example, be inserted under the folded over portion 23 of the elastic band 13 before the folded over portion 23 is stitched down to form the rim 22, resulting in economy of construction.

It is apparent that the elastic band 13 and the loop 16 may be interconnected by any conventional method, such as sewing, to form the pouch 10. The pouch 10 likewise may be attached to the arm band 12 conveniently by sewing. However, due to the strenuous activity of tennis, the various interconnections should be sturdy. The gripping power of the mouth to the pouch 10 should be strong enough to hold the tennis ball securely, while permitting easy storage and removal of the ball.

In the preferred embodiment a piece of thin plastic tubing 24 (FIG. 3) is inserted in the rim 22 to increase the strength and gripping power of the opening of the pouch 10 and to shape the mouth of the pouch 10 conveniently for the receipt of the tennis ball. The length of the piece of plastic tubing 24 has been found to be optimally at least half of the circumference of a tennis ball.

Although the holder of the invention has particular utility as to a tennis ball, it is obvious that the pouch may be sized for a golf ball or for other objects of relatively light weight and compact shape, where it is desirable to have the object immediately available to the hands but to have the hands free.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A holder for an object of relatively light weight and compact shape such as a tennis ball or the like, the holder adapted to be worn on the lower arm, comprising:

an elastic tube, fabricated of material containing a major element characterized by soft absorbency for comfort on the arm and absorbence of perspiration, and adaptable to be stretched over the hand and worn on the arm; and a pouch attached to said elastic tube, said pouch including a substantially circular elastic band in relatively tangential attached position on said elastic tube for receiving and gripping the object to be held, and a shallow generally semi-circular loop of elastic material having its ends attached to said elastic band for supporting said object when in the pouch, and the width of the material of the loop being less than the diameter of said substantially circular elastic band for providing openings between the sides of said loop and said elastic band for application of pressure on the object in the removal of the object from the pouch, the material of said elastic tube being of sufficient thickness and absorbency to deter the flow of perspiration therethrough to the object being held, and the elastic tube being of sufficient width to underlie the loop and cooperate therewith to prevent direct contact of the object with perspiration on the arm of the wearer.

2. The holder of claim 1, wherein said elastic band is formed of a web of material, the outer edge of said band being folded inwardly to form a strengthening and gripping rim for said pouch.

3. The holder of claim 2, wherein said pouch also includes an insert of thin plastic tubing in said folded over rim for shaping the entry of said pouch and for increasing the strength and gripping power of said rim of said pouch.

4. The holder of claim 1, wherein said elastic band and said loop are formed from a web of the same material.

* * * * *